United States Patent [19]

Lustig

[11] Patent Number: 4,553,143

[45] Date of Patent: Nov. 12, 1985

[54] LOW COST PANEL DISPLAY ADDRESSING STRUCTURE

[75] Inventor: Claude D. Lustig, Lexington, Mass.

[73] Assignee: Sperry Corporation, New York, N.Y.

[21] Appl. No.: 397,657

[22] Filed: Jul. 12, 1982

[51] Int. Cl.[4] ..... G09G 03/20

[52] U.S. Cl. ..... 340/719; 340/794; 340/781; 340/815.2; 250/213 A

[58] Field of Search ..... 340/718, 794, 781, 815.2, 340/719; 356/350; 250/213 A; 357/19

[56] References Cited

U.S. PATENT DOCUMENTS

| | | | |
|---|---|---|---|
| 3,078,373 | 2/1963 | Wittenberg | 340/794 X |
| 3,940,757 | 2/1976 | Purchase | 340/794 X |
| 4,189,729 | 2/1980 | Baker et al. | 340/718 X |
| 4,367,467 | 1/1983 | Emile, Jr. | 340/718 X |
| 4,392,131 | 7/1983 | Walter | 340/718 X |

*Primary Examiner*—Gerald L. Brigance
*Assistant Examiner*—Vincent P. Kovalick
*Attorney, Agent, or Firm*—Howard P. Terry

[57] ABSTRACT

A flat panel display in which photoresistive dividers on a first substrate are coupled to the leads of an optical display on a second substrate, such as an electroluminescent panel, by means of elastomeric connectors for coupling the photoresistor conductive leads to corresponding leads of the optical display means.

5 Claims, 6 Drawing Figures

LOW COST PANEL DISPLAY ADDRESSING STRUCTURE

BACKGROUND OF THE INVENTION

1. Field of the Invention

This invention pertains to the field of flat panel displays and more specifically to the construction of an electroluminescent flat panel display using a minimum of driving circuitry.

2. Description of the Prior Art

Flat panel displays are useful for the display of alphanumeric and graphic information in applications including computer readouts, plotting and tracking displays, and the like. Such displays are lighter in weight than CRT displays and due to their flat panel construction may be placed in consoles having a more limited depth than that required for CRTs. Most flat panel displays utilize an array of small discrete electro-sensitive areas known as pixels that either generate light or reflect light in response to an electrical signal. The pixels may comprise a.c or d.c. electroluminescent materials, light emitting diodes, liquid crystals, etc., and may be addressed either individually, or in a matrix array with half select techniques.

Displays of practical size, however, require a large number of addressing circuits even when organized in a matrix array, thereby significantly increasing the cost and complexity of the resulting display system. For example, a flat panel display containing 10,000 pixels in a 100×100 row and column configuration would require 10,000 individual circuits for each pixel in a direct addressing system. Most matrix organized flat panel displays, however, utilize a row and column half select addressing system in which the pixels in an individual row have a lead in common, and the pixels in each column also have a lead in common. Thus, by addressing the appropriate column and row, individual pixels may be energized. For the previous example of a 100×100 matrix display, 200 addressing circuits would be required, one hundred for the rows and one hundred for the columns. It is, however, desirable to reduce this number further.

Applicant's copending application, Ser. No. 317,688, filed Nov. 2, 1981, now U.S. Pat. No. 4,467,325, assigned to the assignee of the present invention, describes an apparatus that provides a greatly reduced number of addressing circuits for use with display media that have a steep brightness voltage threshold, such as, for example, electroluminescent materials. In this addressing structure the display panel is coupled to arrays of photoresistors deposited along two adjacent edges of the panel and illuminated by scanning gas discharge light sources which are contained in separate envelopes. Relatively few drive circuits are required for this scheme, resulting in substantial cost savings. The cost, however, of the display panel itself, consisting of electroluminescent and photoconducting materials deposited on the same substrate, can be fairly high if the yields for the electroluminescent and photoconducting material fabrication is low.

It is important that every photoresistor in this system is a fully working element since one defective device may cause a whole display line of a matrix display, namely either a row or a column, to be non-functional. Depending upon manufacturing techniques, the yield of photoresistor arrays in which every element is working may be low. If the photoconducting devices are fabricated directly onto the electroluminescent panel substrate, a low yield for fully functional photoresistor arrays represents a high expense, since many substrates will either be discarded or cleaned for reuse. Also, there may be incompatibilities in the processing techniques used for both the photoconductor and electroluminescent material and furthermore the relatively large size of substrates which must include both electroluminescent and photoconducting materials may result in a smaller throughput for evaporators or annealing ovens, thus increasing fabrication costs.

The present invention provides a structure permitting the electroluminescent and photoconductive layers to be processed on different substrates and interconnected thereafter. Thus, a low yield of the fabricated photoresistors will not require discarding of the electroluminescent panels. Additionally, by separating the elements, a greater fabrication throughput is possible and there is no possibility of a lack of compatibility in the processing techniques used for the electroluminescent and photoconductor fabrication.

SUMMARY OF THE INVENTION

A flat panel display embodying the principles of the present invention comprises a photoresistor divider network on a first substrate, which divider has a plurality of conductive output leads on the first substrate. Individual photoresistor dividers are coupled to conductive leads through which addressing pulses are coupled upon application of light to an appropriate photoresistor. The photoresistor divider conductive leads are coupled to the conductive leads of an optical display panel on a second substrate thus coupling the addressing pulse to selected leads of the optical display panel.

DESCRIPTION OF THE PREFERRED EMBODIMENTS

Figure 1:
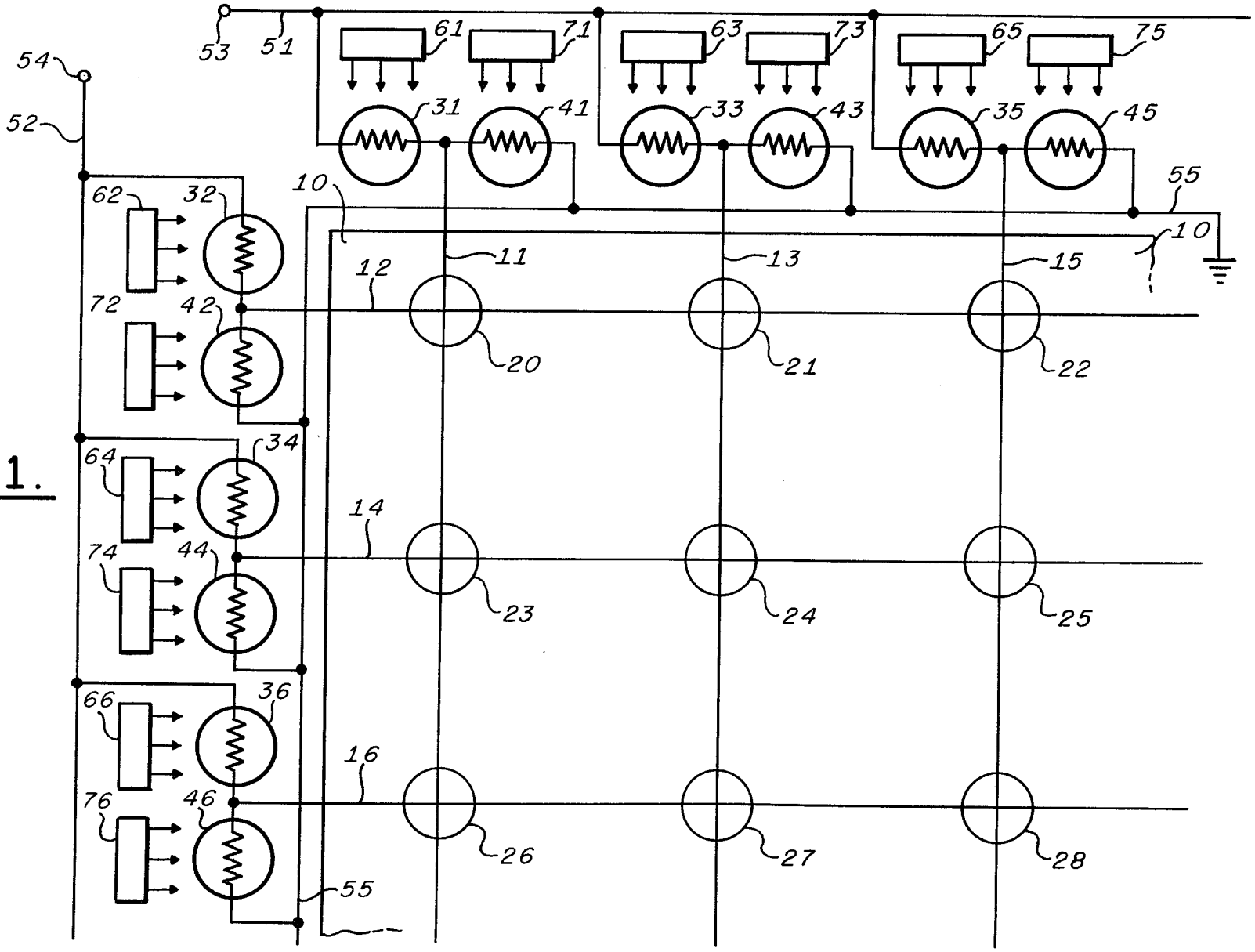
FIG. 1 is a schematic representation of an addressing scheme useful in explaining the operation of the invention.

Referring to FIG. 1, a schematic drawing of a basic flat panel addressing system in which the present invention is used is shown including an electroluminescent panel 10. Electroluminescent panel 10 is comprised of vertical parallel grids 11, 13, and 15 which intersect with horizontal parallel grids 12, 14 and 16, the intersections of which form pixels 20 through 28 such that simultaneous energization of the appropriate vertical and horizontal grids will result in illumination of a selected pixel. For example, if grids 13 or 14 are energized, pixel 24 will become illuminated. Vertical grid 11 is coupled to the junction of coupling photoresistor 31 and decoupling resistor 41. Likewise, the remaining vertical grids 13 and 15 are coupled to the junctions of photoresistors 33 and 43 and photoresistors 35 and 45, respectively. In a similar manner, horizontal grid 12 is coupled to the junction of coupling photoresistor 32 and decoupling photoresistor 42 as are remaining grids 14 and 16 coupled to the junctions of photoresistors 34 and 44 and 36 and 46, respectively. The remaining terminal of decoupling photoresistors 41 through 46 are coupled to lead 55 which is in turn coupled to ground while the remaining leads of coupling photoresistors 31, 33 and 35, are each coupled to vertical addressing lead 51 which is, in turn, terminated in terminal 53. The remaining terminal of coupling photoresistors 32, 34, and 36 are each coupled to horizontal addressing lead 52 which is terminated in terminal 54. Coupling light sources 61, 63, and 65 are used to illuminate vertical coupling photoresistors 31, 33, and 35, respectively, while vertical decoupling light sources 71, 73, and 75 are used to illuminate vertical decoupling photoresistors 41, 43 and 45. In like manner, horizontal coupling light sources 62, 64, and 66 are used to illuminate horizontal coupling photoresistors 32, 34, and 36, respectively. Light sources 72, 74, and 76 are used to illuminate horizontal decoupling photoresistors 42, 44, and 46, respectively.

Operation of the invention can be understood by assuming that it is desired to illuminate pixel 24. In such a case, vertical coupling photoresistor 33 will be illuminated by light source 63 at the same time horizontal coupling photoresistor 34 is illuminated by light source 64. Simultaneously with the illumination of photoconductors 34 and 33, an addressing pulse will be applied to terminals 53 and 54. The addressing pulse coupled to terminal 53 will be coupled by a lead 51 to line 13 since the conductivity of photoresistor 33 increases when it is illuminated by light source 63. In like manner, the addressing pulse applied to terminal 54 will be coupled by a lead 52 to display line 14 since the conductivity of coupling photoresistor 34 is increased under illumination. Assuming that it is desired to scan the pixels of the electroluminescent panel 10, pixel 25 would be the next addressed pixel to be either made luminous or non-luminous depending upon the information which it is desired to display. As the appropriate photocells 35 and 34, are illuminated in order to energize pixel 25, light source 63 would then be extinguished thus causing the conductivity of photoresistor 33 to decrease. Photoresistors generally have, however, a finite conductivity decay time and will still substantially conduct immediately after the extinguishing of the light source. Thus, unless pixel 25 is to be addressed a sufficiently long period after pixel 24 has been addressed, the addressing pulse applied to lead 53 will also be coupled to display line 13 and consequently energize pixel 24. Decoupling photoresistor 43, however, may be used to essentially short any voltages appearing on lead 13 to ground when it is illuminated by light source 73. In such manner an electroluminescent panel of this type may be scanned at a much higher rate.

Light sources 61 through 66 and 71 through 76 may beneficially be derived from a self-scanning gas discharge tube to provide sequential illumination of the adjacent photoresistors with a minimum of drive circuitry in commercially available, compact, packages. One discharge light source operating on the scanning principle is the Burroughs BG16101-2 Dual Linear Bargraph Display, manufactured by the Burroughs Corporation, Electronic Components Division, P.O. Box 1226, Plainfield, N.J. 07061. In these self-scanning gas discharge tubes, a glow transfer mechanism is used to shift a luminous glow repeatedly along an array of small cathode elements. The tubes require only four drivers, one of which is used for a scan initiate function.

Figure 2A:
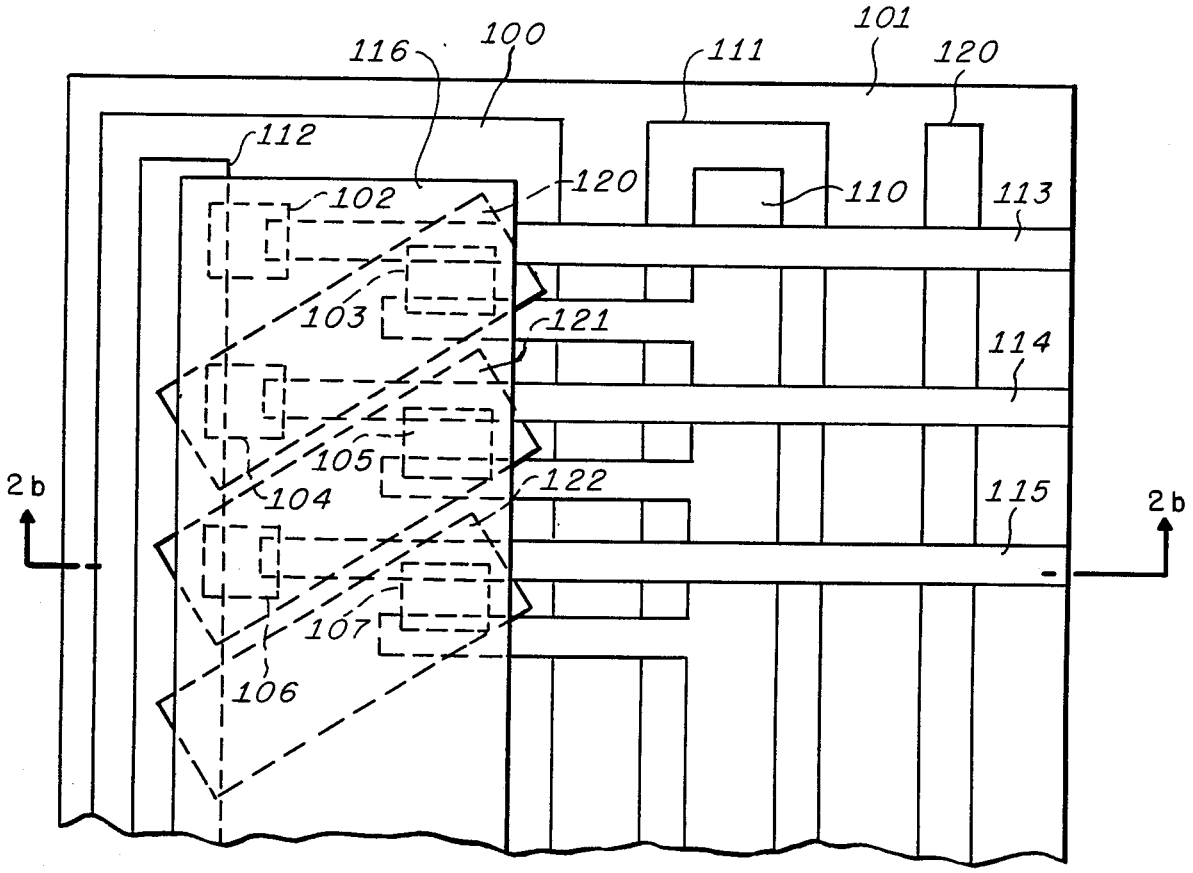
FIGS. 2A and 2B show an embodiment of a photoresistor array useful in conjunction with the present invention.
Figure 2B:
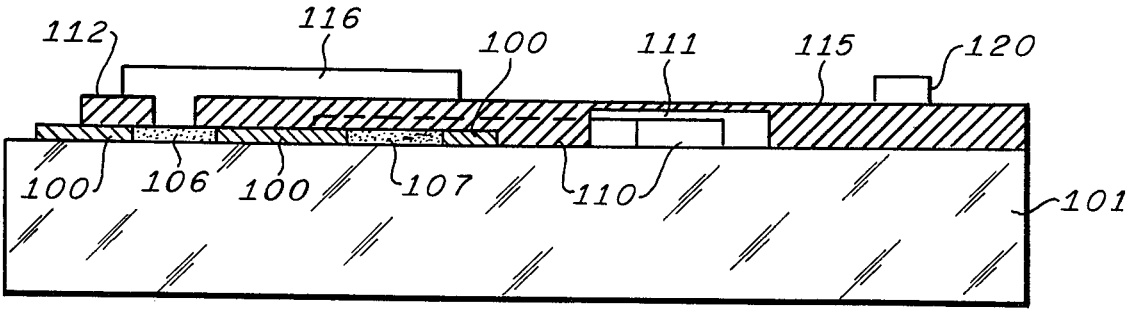

FIG. 2A shows a physical embodiment of the addressing circuitry used to address display lines 12, 14, and 16 as discussed hereinabove. Opaque insulator 100 is deposited onto substrate 101. Opaque insulator 100 has windows 102, 103, 104, 105, 106 and 107 which will form areas for the photoresistors. Ground conductor 110 may be deposited on substrate 101 having portions which extend to the areas of windows 103, 105 and 107. Insulating dielectric 111 may be deposited over the region of ground conductor 110 as shown. Common metal electrode 112 and electrodes 113, 114, and 115 may be deposited next, the latter three electrodes may be metal, if desired. Finally photoconducting material 116 may be screened on thus completing the construction. If desired, a final protective coating, not shown, may be added. FIG. 2B shows the construction of FIG. 2A in cross-sectional view taken through section 2b—2b. Areas 120, 121 and 122 denote the cathodes of a scanning discharge tube to be used in conjunction with the assembly. In operation, the areas delineated by windows 102, 104 and 106 form coupling photoresistors while the areas delineated by windows 103, 105, and 107 indicate the decoupling photoresistors. As can be seen in FIG. 2B, in the region of window 106, the photoresistor thus formed is an in-plane photoresistor since conduction in the photoresistor occurs primarily in a single plane. The dimensions of the photoresistors may be varied relative to one another to adjust the resistance of the coupling photoresistor relative to the decoupling photoresistor to optimize the values of the photoresistors in the resistive divider. The structure is arranged so that the decoupling photoresistor of one line, for example, that delineated by window 103, is illuminated at the same time and by the same cathode as the coupling photoresistor of the next line, namely, the photoresistor delineated by window 104. Alternatively, a second set of cathodes operated synchronously with the first set of cathodes as shown in FIG. 1, may be used in a side-by-side configuration in which the cathodes used to illuminate the coupling photoresistors initiate their scan one cathode ahead of those cathodes used to illuminate the decoupling photoresistors. Clearly, such techniques can be extended to the matrix array addressing scheme. It should further be clear that horizontal conductors 113, 114, and 115 correspond to display lines 12, 14 and 16 as shown in FIG. 1.

In Applicant's copending application Ser. No. 317,688, now U.S. Pat. No. 4,467,325, a structure such as that of FIG. 2 is described in which the electroluminescent materials are deposited on substrate 101, which substrate also accommodates the electroluminescent materials.

Figure 3:
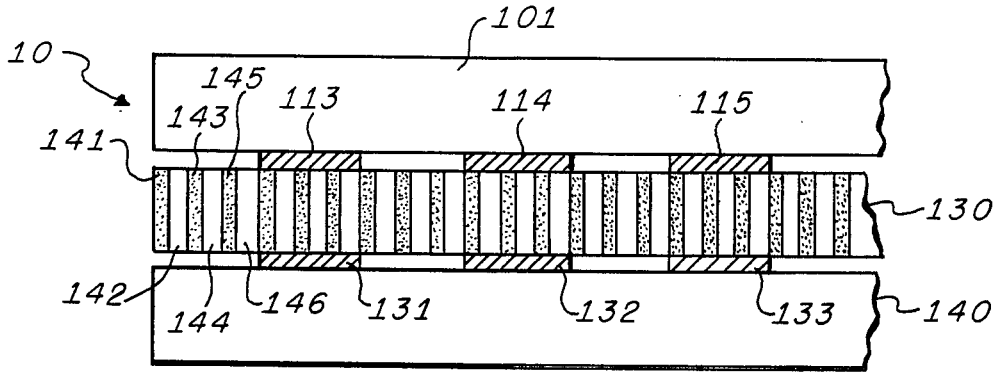
FIG. 3 shows construction of a preferred embodiment of the invention.
Figure 4:
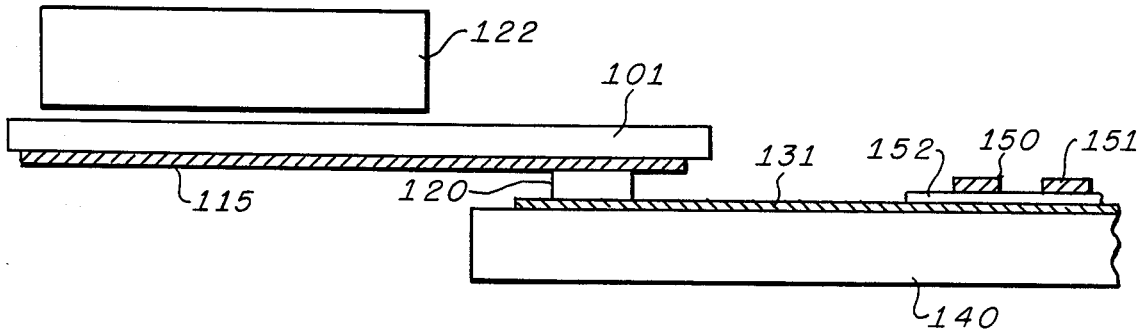
FIG. 4 shows construction of a preferred embodiment of the invention.

In Applicant's present invention, elastomeric connector 120 is applied between the photoconductor assembly of FIG. 2 and the electroluminescent panel 101 as is shown in FIG. 3. Leads 113, 114 and 115 are placed in contact with elastomeric connector 130 forming a sandwich with conductors 131, 132 and 133 which are display element leads corresponding, for example, to leads 12, 14 and 16. Conductors 131, 132 and 133 are deposited on electroluminescent panel substrate 140 which is a portion of electroluminescent panel 10 as described hereinabove. Elastomeric connector 130 is comprised of alternating parallel layers of conductive carbon filled and nonconductive silicon rubber. Such elastomeric connectors are available from Tecknit, 129 Dermody Street, Cranford, N.J. 07016. For example, layers 141, 143, and 145 are carbon filled and, therefore, conductive, whereas layers 142, 144 and 146 are non-conductive. The spacing between conductive layers such as 141 and 142 must be significantly less than the spacing between leads on the display and photoconductor panels, for example, between 113 and 114 and 131 and 132. Otherwise, there may be a failure to couple a given pair of photoconductor and electroluminescent panel leads. Referring now to FIG. 4, a portion of a display panel utilizing the structure of FIG. 3 is shown in cross-section, including light source 122 and additional conductive leads 150 and 151 which correspond, for example, to vertical conductive leads 11 and 13 of FIG. 1. Further display medium 152 is shown between the conductive leads 131 and 150 and 151. Photoconductors which are formed on the surface of substrate 101 and as described in FIG. 2, are illuminated by, for example, light source 122 as shown. Elastomeric connector 120 is sandwiched between the leads 115 and 131 of the photoconductor substrate 101 and electroluminescent panel substrate 140, thereby connecting the leads as previously discussed. Alternatively, a more compact structure may be constructed by locating light source 122 below substrate 101, and reversing the order of the several layers deposited thereon.

It will be clear to those skilled in the art that other forms of electrical connections may also be used. Elastomeric connectors are desirable because of the relative simplicity and ease with which they may be used to make a connection between the appropriate leads. Due to the resiliency of the elastomeric connector, reliable contacts can be made between the appropriate display lines and photoconductor lines. Other methods which may be used include, for example, mating the appropriate leads and evaporating, or painting through a mask a conductor over the joining of the two leads.

Figure 5:
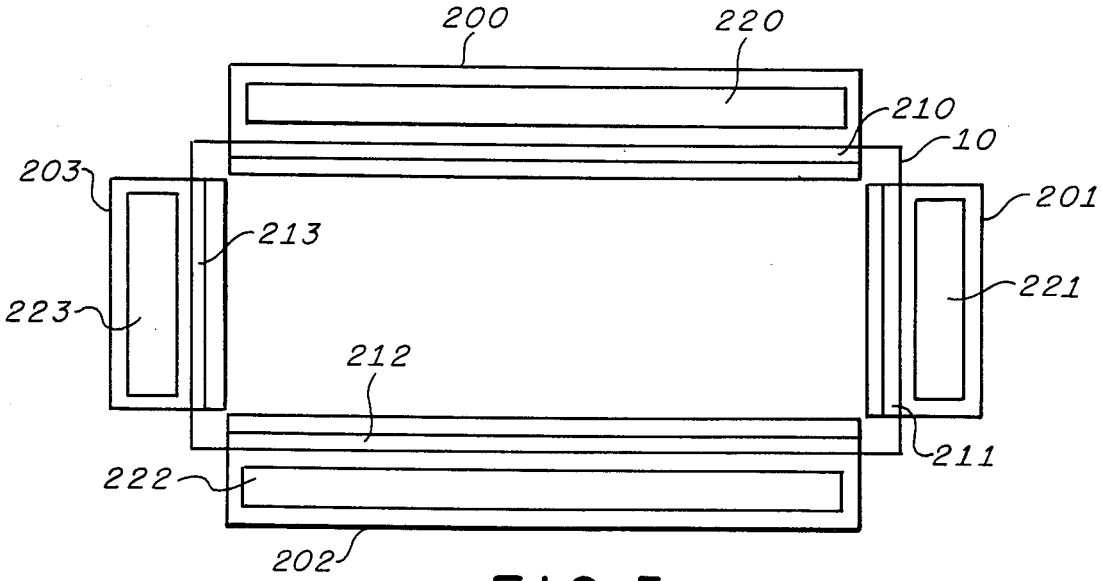
FIG. 5 shows construction of a preferred embodiment of the invention.

Referring now to FIG. 5, an illuminated photoresistor addressing scheme is used for display lines where the display lines are interleaved and emerge roughly symmetrically on all four sides of the panel. Most commercially available flat panel displays, whether of the electroluminescent or a.c. plasma type, have this configuration. Such a structure is shown in FIG. 5 in which electroluminescent panel 10 is mated to photoconductor assemblies 200, 201, 202, and 203 via appropriate elastomeric connectors 210, 211, 212, and 213. This structure allows the low cost addressing scheme to be used in the separate substrate configuration with commercially available display panels thereby eliminating the need for expensive custom design panels in which the leads emerge from only two sides. The four-sided configuration also has the advantages that the resolution of the emerging lead pattern is only half that needed for the two-sided configuration. In the embodiment shown, sources 220, 221, 222 and 223 are used to illuminate photoconductor assemblies 200, 201, 202, and 203, respectively.

Referring again to FIG. 5, although twice as many photoresistor assemblies and scanning light source tubes are required for the four-sided configuration as for a two-sided configuration, no additional driving circuitry is needed. For example, to address the seven display columns which may be used for a $9\times7$ character array, four of the column display lines would emerge along the top of the display, and three along the bottom. The scanning light source tubes would be driven from the same drive circuits, so that the seven columns for a given character would all be coupled at the same time to seven drive circuits. Four of the display lines would be connected to four bus lines connected through photoresistors to the four columns emerging at the top and three would be connected to three bus lines along the bottom of the display. The total number of drive circuits would, therefore, be the same as if all seven display columns emerged at the top of the display. It will also be clear to those skilled in the art that the electroluminescent panel 10 may be addressed on three sides only. Therefore, for example, light source 222 and photoconductor assembly 202 may be eliminated.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. A flat panel display comprising:

a scanning discharge light source including: coupling light sources for sequentially illuminating a plurality of coupling photoresistors, said sequential illumination being substantially in synchronism with addressing pulses applied to said coupling photoresistors, and decoupling light sources for sequentially illuminating a plurality of decoupling photoresistors at a predetermined interval subsequent to illumination of said coupling photoresistors;

photoresistor divider means on a first substrate including a plurality of conductive output leads on said first substrate and further including at least one terminal adapted to receive said addressing pulses, for coupling said addressing pulses through selected coupling photoresistors to selected ones of said plurality of conductive output leads upon selective illumination by said coupling light source, wherein said photoresistor divider means comprises said plurality of coupling photoresistors each coupled at a first end to said terminal means and at a second end to each of said plurality of decoupling photoresistors, each of said decoupling photoresistors is coupled between ground potential and a corresponding one of said plurality of coupling photoresistors, each of said plurality of conductive output leads is coupled to a junction between each of said coupling photoresistors and decoupling photoresistors; and optical display means on a second substrate having a plurality of conductive input leads coupled to said plurality of conductive output leads for providing optical signals in response to said addressing signals.

2. The apparatus according to claim 1 wherein said optical display means comprises an electroluminescent panel.

3. The apparatus according to claim 1 wherein said optical display means comprises an a.c. plasma panel.

4. The apparatus according to the claim 1 wherein said conductive output leads and conductive input leads are coupled by an evaporated conductor, said conductor bridges corresponding ones of said pluralities of said conductive output and conductive input leads.

5. The apparatus according to claim 1 wherein said conductive output leads and conductive input leads are coupled by an elastomeric conductor, said elastomeric connector bridges corresponding ones of said pluralities of said conductive output and conductive input leads.

* * * * *